US005165457A

United States Patent [19]

Olin et al.

[11] Patent Number: 5,165,457

[45] Date of Patent: * Nov. 24, 1992

[54] VACUUM SEWER ARRANGEMENT

[75] Inventors: Henry Olin, Espoo; Gunnar Lindroos, Helsinki, both of Finland; Sven Oldfelt, Vaxholm, Sweden

[73] Assignee: Oy Wartsila AB, Helsinki, Finland

[ * ] Notice: The portion of the term of this patent subsequent to May 29, 2007 has been disclaimed.

[21] Appl. No.: 717,877

[22] Filed: Jun. 13, 1991

Related U.S. Application Data

[63] Continuation of Ser. No. 460,360, Jan. 2, 1990, abandoned, which is a continuation-in-part of Ser. No. 177,070, Apr. 4, 1988, Pat. No. 4,928,326.

[30] Foreign Application Priority Data

Apr. 6, 1987 [FI] Finland ..... 871491

[51] Int. Cl.[5] ..... E03D 5/02

[52] U.S. Cl. ..... 4/300; 4/316; 4/431; 4/438; 4/DIG. 9; 137/205

[58] Field of Search ..... 4/300, 316, 431-435, 4/438-442, 329, 330, 332, 340, 342, 234, DIG. 9; 137/205

[56] References Cited

U.S. PATENT DOCUMENTS

| | | | |
|---|---|---|---|
| 2,155,286 | 4/1939 | Winding | 4/234 |
| 2,472,457 | 6/1949 | Ash | 4/300 |
| 3,623,504 | 11/1971 | Davis | 137/525 |
| 3,686,693 | 8/1972 | Liljendahl | 4/300 |
| 3,788,338 | 1/1974 | Burns | 137/205 X |
| 3,996,628 | 12/1976 | Mollerstedt | 4/433 X |
| 4,063,315 | 12/1977 | Carowan et al. | 4/316 |
| 4,184,506 | 1/1980 | Varis et al. | 137/205 |
| 4,199,828 | 4/1980 | Hellers | 4/431 X |
| 4,304,740 | 2/1992 | Cernoch | 5/542 X |
| 4,306,321 | 12/1981 | Norlin | 4/433 |
| 4,357,719 | 11/1982 | Badger et al. | 4/316 |
| 4,376,315 | 3/1983 | Badger et al. | 4/431 |
| 4,520,513 | 6/1985 | Raupuk, Jr. et al. | 4/316 X |
| 4,621,379 | 11/1986 | Kilpi | 4/431 |
| 4,713,847 | 12/1987 | Oldfelt et al. | 4/316 |
| 4,791,688 | 12/1988 | Krishnakumar et al. | 4/316 X |
| 4,791,949 | 12/1988 | Tank | 4/431 X |

FOREIGN PATENT DOCUMENTS

| | | | |
|---|---|---|---|
| 8524288 | 1/1986 | Fed. Rep. of Germany . | |
| 82071739 | 12/1982 | Sweden . | |
| 0002907 | of 1900 | United Kingdom | 4/432 |
| 2194260 | 3/1988 | United Kingdom | 4/300 |
| 2203461 | 10/1988 | United Kingdom . | |

*Primary Examiner*—Henry J. Recla
*Assistant Examiner*—Casey Jacyna
*Attorney, Agent, or Firm*—Dellett, Smith-Hill and Bedell

[57] ABSTRACT

A vacuum sewer arrangement comprises a valve controlled air inlet duct to let air into the vacuum sewer at a position downstream of the sewer valve. The sewer valve can then be closed immediately after the sewage has passed into the vacuum sewer, because the air required for the sewage transport is received from the air inlet duct. Hence, the amount of air that flows into the sewer through the sewer valve when the sewer valve opens is small, and when the sewer valve is closed, air flows through the air inlet duct into the sewer, which reduces the pressure difference acting on the sewer valve. These measures tend to considerably reduce the noise level. In the case of a vacuum toilet sewer arrangement, the noise level can be further reduced by providing the toilet bowl with a lid forming a substantially airtight and soundproof closure at the top of the bowl. The volume of air contained in the bowl may be too small for proper discharge of the sewage, in which case additional air can be provided through a separate tube. This tube may be connected to the air inlet duct upstream of its valve.

13 Claims, 5 Drawing Sheets

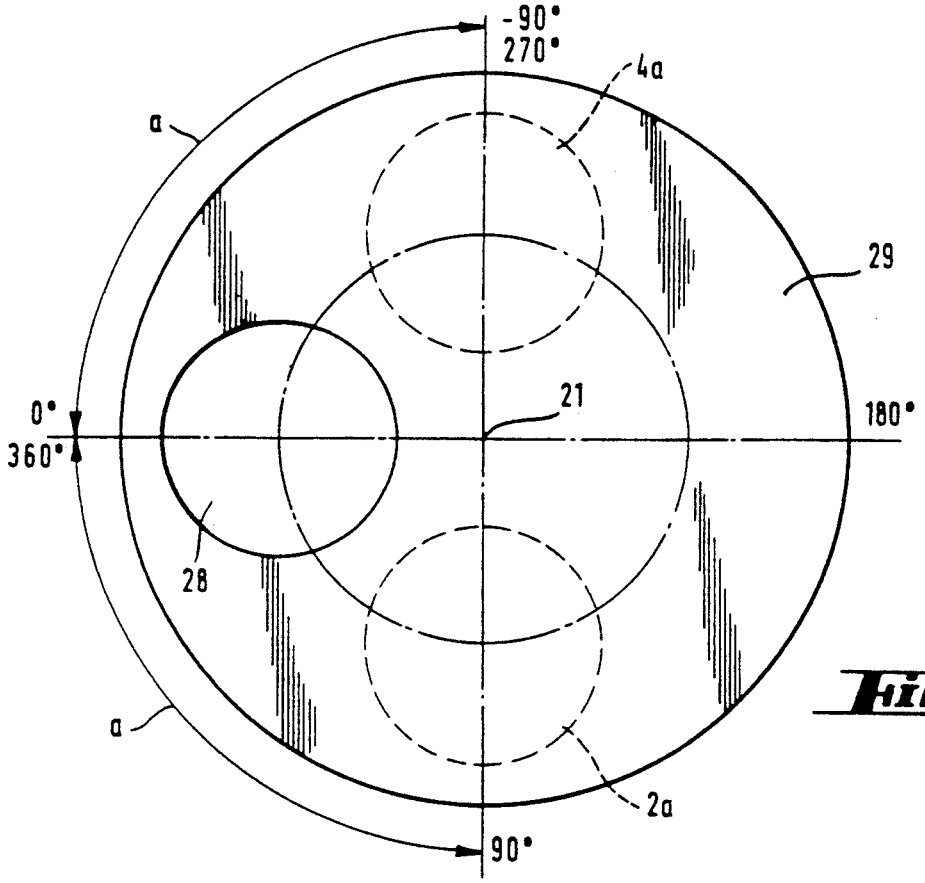
Fig. 2
Fig. 3A
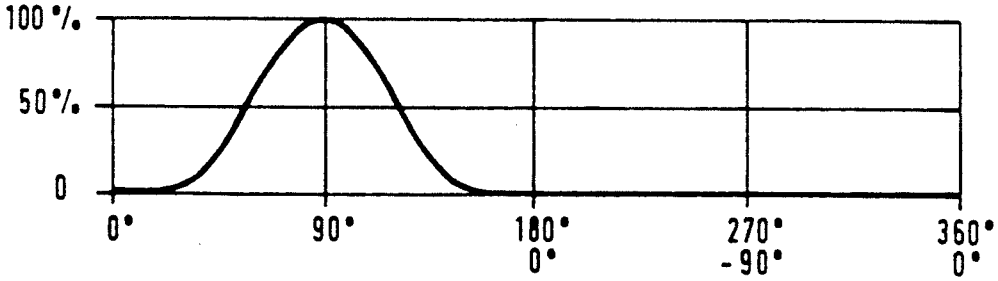
Fig. 3B
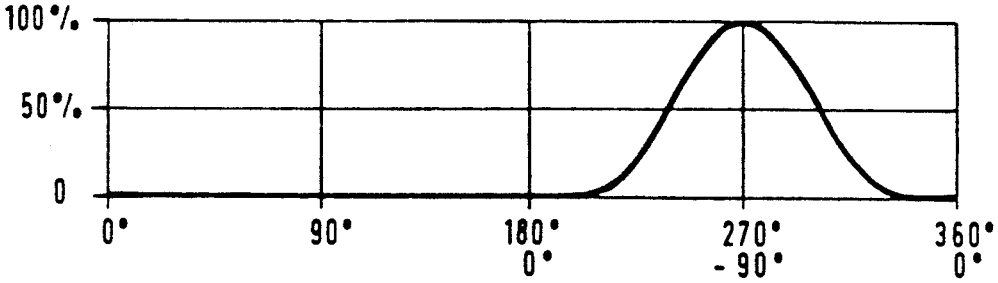

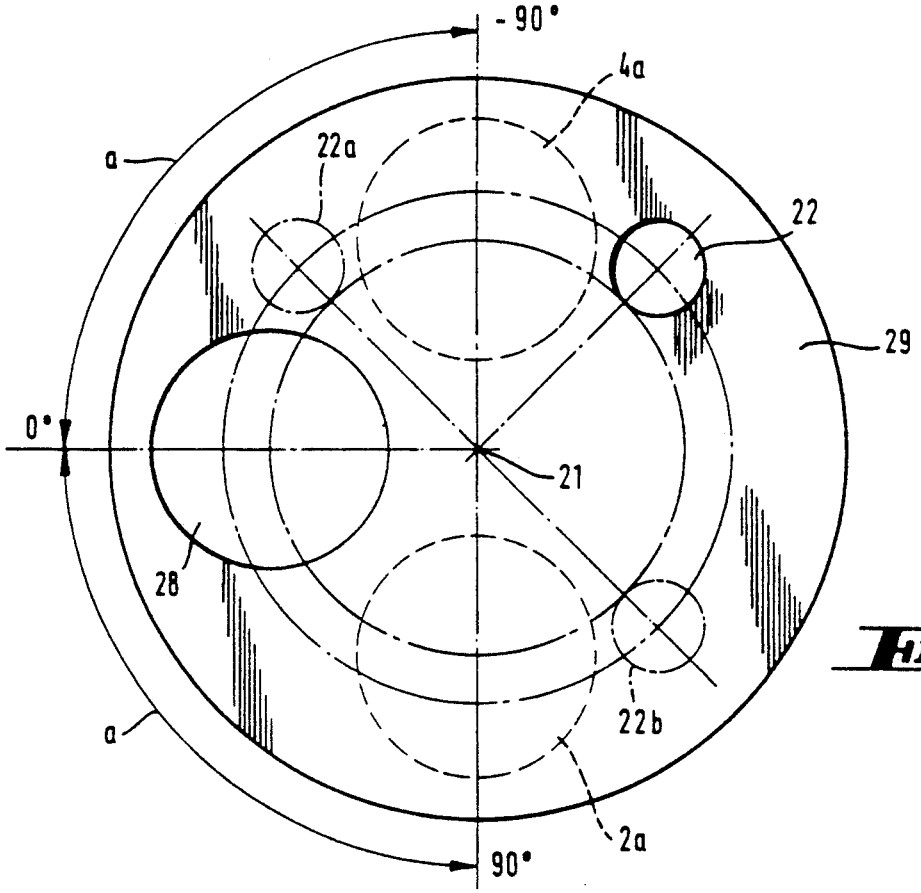
Fig. 4
Fig. 5A
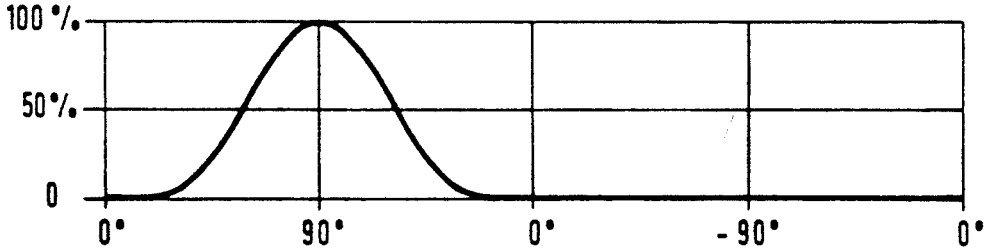
Fig. 5B
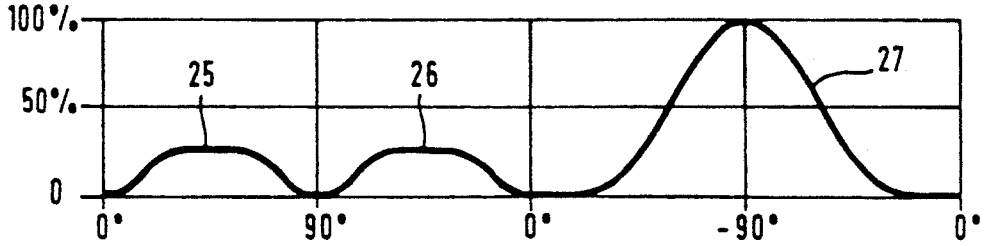

VACUUM SEWER ARRANGEMENT

CROSS-REFERENCE TO RELATED APPLICATIONS

This is a continuation of co-pending application Ser. No. 07/460,360 filed Jan. 2, 1990 and now abandoned, which was filed as a continuation-in-part of co-pending application Ser. No. 07/177,070 filed Apr. 4, 1988 now U.S. Pat. No. 4,928,326 issued May 29, 1990.

BACKGROUND OF THE INVENTION

The invention relates to a vacuum sewer arrangement.

In a vacuum sewer arrangement, a toilet bowl is connected to a sewer by means of a sewer valve, and a vacuum is maintained in the sewer. In order to carry out a flushing operation, the sewer valve is opened and waste in the toilet bowl is inducted into the sewer. The flushing operation includes the following phases:

a) the sewer valve opens, b) the waste in the bowl is pressed into the sewer by the pressure difference between the sewer and the toilet bowl, c) air enters the sewer behind the waste, and d) the sewer valve closes.

The waste forms a movable plug in the vacuum sewer, and the pressure difference across the plug propels the plug through the sewer to a waste receiving tank. In a conventional vacuum sewer arrangement, air for transportation of the waste plug enters the sewer by way of the sewer valve. When the sewer valve closes, the plug stops moving almost immediately.

Two main factors determine how long the sewer valve remains open. First, the sewer valve must remain open for long enough to ensure, with a reasonable degree of certainty, that the waste in the toilet bowl has entered the sewer. Although normally the waste is pressed into the sewer almost instantaneously, it is usual to allow about two seconds for the waste to enter the sewer. Second, it is important for proper operation of a vacuum sewer arrangement that the chance of a waste plug merging with a preceding or succeeding plug in the sewer by very small, and therefore it must travel a substantial distance along the sewer, for example at least 10 m, before stopping. In vacuum sewer arrangements that are currently in use, the waste plug typically travels at a maximum speed of about 5–10 m/s. Therefore, in a typical vacuum sewer arrangement, the sewer valve remains open for about four seconds on each flush.

The waste will enter the sewer immediately the sewer valve opens, followed by a large quantity of air. This causes considerable pressure variations in the toilet bowl, in particular during the opening and closing phase of the sewer valve when material (waste or air) is inducted through a relatively small opening. Due to this, a high noise level is generated. The noise level is dependent on the pressure difference between the toilet bowl and the sewer—the greater the difference, the greater the noise.

Krishnakumar et al, U.S. Pat. No. 4,791,688 issued Dec. 20, 1988, discloses a vacuum sewer arrangement comprising multiple toilet bowls connected through respective sewer valves and sewers to a transfer manifold. When a flush control for one of the toilet bowls is actuated, a macerator pump starts recirculating waste from a waste receiving tank through a jet pump whose suction inlet is connected to the transfer manifold.

Within about 3 seconds, vacuum is built up in the manifold. A controller device then opens a toilet flush valve for supplying rinse water to the toilet bowl, and subsequently opens the toilet bowl's sewer valve. Waste is drawn from the toilet bowl into the sewer and is transported into the manifold. After a few seconds of evacuation, the controller closes the sewer valve, and about 1 second later closes the flush valve, discontinuing supply of rinse water. A solenoid-operated air inlet valve is then opened, allowing air to flow directly into the manifold. The air inlet valve remains open for several minutes, and the controller then shuts off the macerator pump and closes the air inlet valve.

The air supplied by the air inlet valve of Krishnakumar et al transports the waste from the transfer manifold into the holding tank, but does not aid in transport of sewage from the toilet bowl to the transfer manifold. Since the air inlet valve opens at an unspecified time after the sewer valve closes, operation of the air inlet valve can have no effect on the process of emptying the toilet bowl, and hence has no effect on the noise level. Further, since the distance of the solenoid valve from the sewer valve is different for the different toilet bowls, it is evident that there is not a timed relationship, uniform for all the toilet bowls, between the time that the sewer valve opens and the time that the waste is placed under the influence of air that has entered through the air inlet valve.

The description of the system disclosed by Krishnakumar et al does not refer either to the waste being transported in the form of movable plugs or to a reduction of the noise level.

SUMMARY OF THE INVENTION

The object of the invention is to provide a vacuum sewer arrangement, which, in particular when used as a toilet sewer arrangement, considerably reduces the noise level. The noise level of a vacuum toilet sewer arrangement in accordance with the invention can be reduced to approximately that of a conventional gravity toilet, that is, to a level considerably below the noise level of a conventional vacuum toilet.

According to the invention, a valve controlled air inlet duct is employed to let air into the vacuum sewer at a position close to the sewer valve, after the waste has entered the sewer. Thus, at least some of the air required for transport of the sewage plug enters the sewer separately from the sewer valve, and it is only necessary to hold the sewer valve open for a sufficient time to be reasonably sure that the sewage enters the vacuum sewer and passes the air inlet duct. Consequently, it is possible to close the sewer valve after about 2 seconds, although it is preferred that the sewer valve remain open between 2.5 and 3.5 seconds, typically about 3 seconds. By reducing the length of time for which the sewer valve is open, the time during which noise is generated by induction of air into the sewer through the toilet bowl is also reduced. Moreover, even when the sewer valve is still open, air is supplied to the sewer not only through the sewer valve but also through the air inlet valve so that the rate at which air is supplied through the toilet bowl, and hence the noise level, is reduced.

The air inlet duct can be made sound insulated and can be provided with a muffler. Then air flowing through the air inlet duct will not cause a disturbing level of noise. The noise level of a vacuum toilet sewer arrangement according to the invention can be further reduced by providing the toilet bowl with a lid forming a substantially airtight and sound-proof closure at the top of the bowl. In this case, it is favorable that the lid be of relatively thick sound insulating material. Various plastic materials, sandwich structures etc. are well suited for this purpose. If the lid provides a seal, the volume of air contained in the bowl may be too small for proper discharge of the sewage from the bowl, in which case additional air can be provided through a separate tube. This tube may be connected to the air inlet duct upstream of its valve. In a vacuum toilet sewer arrangement of this structure, the lowest noise level is achieved.

The connection of the air inlet duct to the sewer is sufficiently close to the sewer valve that in normal operation of the vacuum sewer arrangement, the sewage plug formed when the waste enters the sewer through the sewer valve will pass the outlet of the air inlet duct less than one second after the sewer valve reaches its fully open condition, and preferably less than 0.5 seconds after the sewer valve reaches its fully open condition. The air inlet valve opens less than 2.5 seconds after the sewer valve opens, and preferably between 1 and 2 seconds after the sewer valve opens, and most preferably about 1.5 seconds after the sewer valve opens. However, the time at which the air inlet valve opens must be selected relative to the distance between the sewer valve and the outlet of the air inlet duct and the expected speed of travel of the sewage plug so that the air inlet valve will not open before the sewage plug has passed the air inlet duct, since otherwise proper transportation of the plug might not be achieved. The air inlet valve stays open for about 5 seconds or less. This introduces slightly more transport air into the sewer than what is usual in conventional vacuum sewer systems. The increased amount of air provides a longer travel distance for the sewage plug.

Conventionally, the sewer valve of a vacuum sewer arrangement is operated by using the vacuum present in the vacuum sewer. In an arrangement according to the invention the same vacuum can be used also for operating the air inlet valve. This gives a simple and reliable structure. Preferably, valves of the same or substantially the same structure are used both as sewer valve and as air inlet valve. This simplifies production and spare part service, because only one valve type is needed. Moreover, use of vacuum-actuated valves for both the sewer valve and the air inlet valve allows the delay between opening of the sewer valve and opening of the air inlet valve to be obtained by supplying the pressure difference needed for operating the sewer valve also to the air inlet valve, but through a throttled tube, whereby the throttling provides the required time delay in activating the air inlet valve.

The vacuum available from the sewer may not be sufficient to operate two valves, particularly because there is a pressure rise in the vacuum sewer when the sewer valve opens. Operating difficulties due to insufficient vacuum can easily be avoided by arranging a vacuum accumulator between the vacuum sewer and the control device of the sewer valve. A check valve should be arranged between the vacuum accumulator and the sewer, so that a pressure rise in the sewer is unable to have any influence on the pressure in the vacuum accumulator.

In some vacuum sewer arrangements, use of a mechanically or electrically operated sewer valve is preferred. This is the case in an aircraft vacuum toilet sewer arrangement, where the amount of flush water is extremely small, only about 0.2 liter or less. In this case, the sewer valve must function with a very high accuracy. For this type of vacuum toilet, U.S. Pat. No. 4,713,847, the disclosure of which is hereby incorporated by reference herein, suggests the use of a valve in which the closure member is an apertured rotatable disc. Such a rotatable valve disc can be driven by a motor, a solenoid and/or by a mechanical power transmission. Further, this type of valve, as well as many other valve types, can easily be so designed that the valve works as a three-way valve, which in one operating position connects the air inlet duct to the vacuum sewer and in another operating position connects the sewage providing unit to the vacuum sewer. It is also feasible to provide a rotatable valve closure member with two apertures, of which one functions as a flow aperture of the sewer valve and the other functions as a flow aperture of the air inlet valve.

In the case where a very strong vacuum (=very low absolute pressure) is used in the sewer in order to provide for an efficient sewage transport or for other reasons, the pressure difference acting across the sewer valve might be unfavorably high. This pressure difference may be reduced by providing air to the sewer through the air inlet duct during the opening phase. However, in this case the rate of supply of air through the inlet duct during the opening phase of the sewer valve must be limited in order to avoid interference with induction of sewage into the sewer.

It is not essential to all embodiments of the invention that the air inlet valve open before the sewer valve closes.

In this specification and in the claims "vacuum" means "partial vacuum" of a magnitude suitable for use in a vacuum sewer system. Conventionally, the vacuum in such a system is about ½ atmosphere, or about 38 cm Hg.

BRIEF DESCRIPTION OF THE DRAWINGS

The invention will now be described in greater detail with reference to the accompanying drawing, in which FIG. 1 schematically shows an embodiment of the invention with a vacuum operated sewer valve, FIG. 2 schematically shows a combined valve device according to the invention, FIG. 3A and 3B show function diagrams of a valve according to FIG. 2, FIG. 4 shows a modification of the valve according to FIG. 2, FIGS. 5A and 5B show function diagrams of a valve according to FIG. 4.

DETAILED DESCRIPTION

Figure 1:
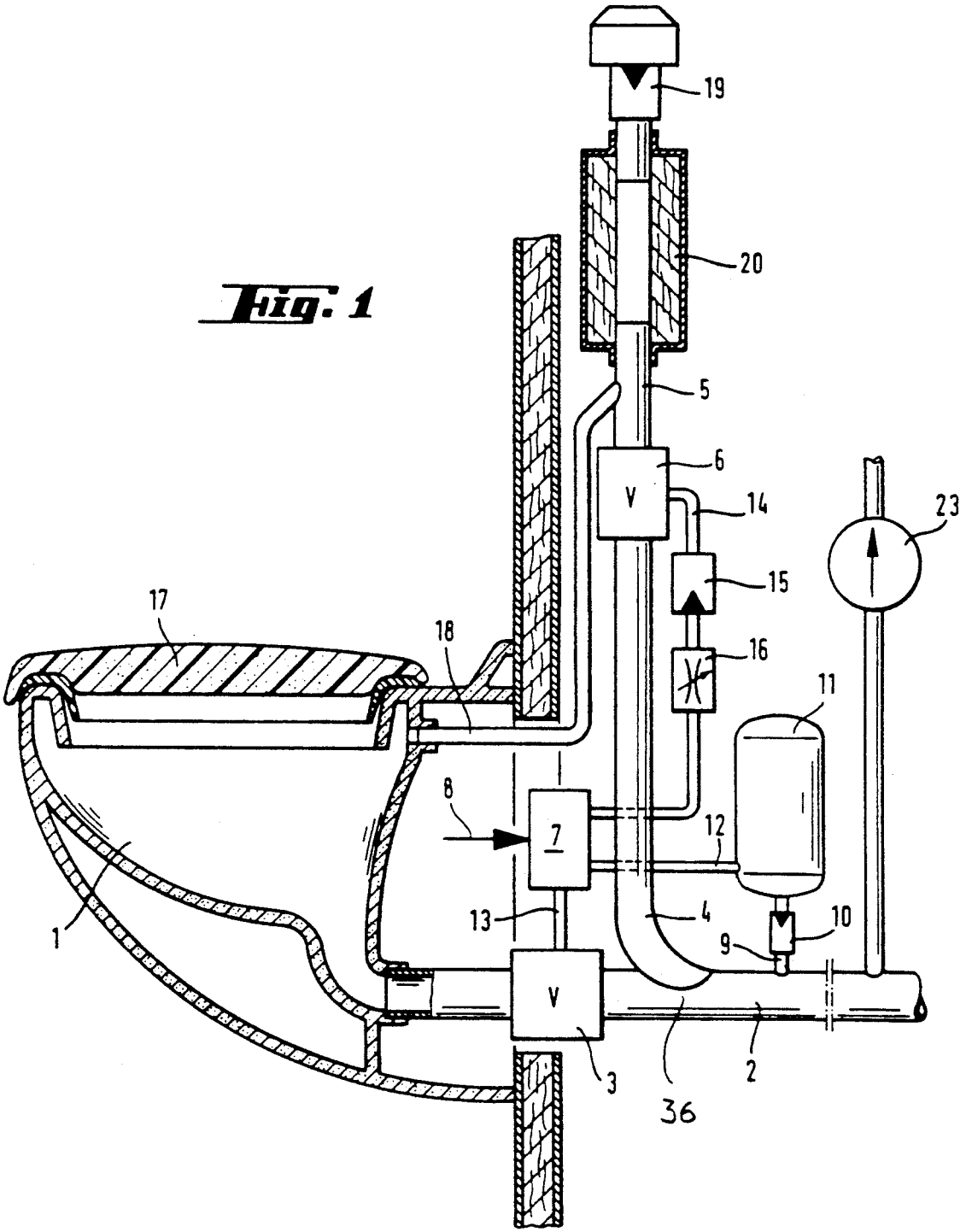

FIG. 1 illustrates a toilet bowl 1 and a sewer 2 connected to the toilet bowl by a sewer valve assembly 3. The interior space of the sewer 2 is maintained under vacuum, which is provided as known per se, by a vacuum pump 23. This pump is usually connected to the downstream end of the sewer 2, or may be connected to a sewage collecting tank (not shown). The sewer valve assembly 3 includes a sewer valve proper and a sewer valve operating device which opens the sewer valve by using vacuum. Various valve assemblies of this type are described in U.S. Pat. Nos. 3,482,267, 3,807,431, 3,984,080 and 4,376,444. Since suitable vacuum operated valves are known, the structure of the sewer valve assembly will not be explained here.

An air inlet duct 4 opens into the sewer 2 through an outlet 36. An air inlet valve assembly 6, which in the embodiment shown in FIG. 1 is of the same structure as the sewer valve assembly 3, and accordingly includes an operating device which opens an air inlet valve in response to vacuum, is connected to the air inlet duct 4. The upstream side 5 of the valve assembly 6 is connected through a check valve 19 and a muffler 20 to the ambient atmosphere. A control device 7, which controls both valve assemblies 3 and 6, is activated by a function impulse 8. Such an impulse may originate from a push button operated by the user of the toilet and may be transmitted, for instance mechanically, in the form of a pressure impulse, or electrically, to the control device 7. The function impulse 8 may be dependent on, for instance the closing of a lid 17 of the toilet bowl or on other factors which are relevant to controlling the flushing of the toilet. Since these factors also are well known in the art, neither the creating of a function impulse nor the manner of operation of the control device 7 will be explained here.

A general principle in a vacuum sewer arrangement is that the sewer valve should open only when there is sufficient vacuum in the sewer for effective transport of sewage. In order to achieve this, the vacuum required to open the sewer valve is taken from the sewer 2 or from another point of the vacuum system. If the available vacuum is too weak for effective transport of sewage, the sewer valve will not open. In the embodiment of FIG. 1 the vacuum required for the operation of the sewer valve is communicated from the sewer 2 to the control device 7 through a tube 9, a check valve 10 and a tube 12. A vacuum accumulator 11 may be connected between the valve 10 and the tube 12. Upon receiving a function impulse 8, the control device 7 transmits vacuum received from the sewer 2 and/or from the vacuum accumulator 11 through a tube 13 to the sewer valve operating device, which then opens the sewer valve. At the same time the control device 7 transmits vacuum through a tube 14 towards the air inlet valve assembly 6, and the air inlet valve opens when its operating device comes under the influence of vacuum.

Transmitting vacuum to a device means in practice that the atmospheric pressure in the device is allowed to disperse into a space where the pressure is lower. Hence, when the vacuum is connected to the operating device of the valve assembly 6, air contained in the operating device flows away through the tube 14. Since it is usually desirable that the air inlet valve opens slightly later than the sewer valve, the air flow from the operating device of the valve assembly 6 is slowed down. This can be obtained by means of a preferably adjustable throttling device 16. The tube 14 may also be provided with a check valve 15, which does not provide a quite tight closure, but allows also in its closed position a small throttled flow of air from the valve assembly 6 to the control device 7. This provides different throttling in the tube 14 in different flow directions.

The use of a vacuum accumulator 11 is not always necessary. The object of the vacuum accumulator is to insure that a sufficient amount of vacuum is available for operating the sewer and air inlet valves. When the sewer valve opens, the pressure in the sewer 2 rises. The check valve 10 is provided in order to prevent this higher pressure from reaching the tube 12 and reducing the vacuum present in the operating devices of the valve assemblies 3 and 6. The vacuum accumulator 11 also enlarges the volume under vacuum, so that there will certainly be enough vacuum for operating both the sewer valve and the air inlet valve.

It is, of course, also possible for the sewer valve and the air inlet valve to be operated electrically, for instance by means of a motor, a solenoid or the like.

The distance of the outlet 36 of the air inlet duct from the sewer valve assembly 3 and the delay between opening of the sewer valve and opening of the air inlet valve are selected so that, in normal operation, the air inlet duct 4 supplies air to the sewer soon after the sewage plug from the toilet bowl has passed the outlet 36. Since air for transporting the plug is then provided through the air inlet duct, the sewer valve need not be held open any longer than is necessary to ensure that the plug has passed the outlet 36. When the sewer valve closes, air is no longer inducted through the toilet bowl and the noise level is reduced. Moreover, when both the sewer valve and the air inlet valve are open, air is inducted through the sewer valve at a lower rate and the noise level is reduced.

The basic structure of an arrangement according to the invention requires that air is led through the air inlet duct 4 to the vacuum sewer 2 when the sewage providing unit 1 is to be emptied. This substantially reduces the noise level, but nevertheless, the noise level might be unpleasantly high. Hence, letting in air by way of an air inlet duct is not always sufficient to reduce the noise level to an acceptable value. Additional measures might be necessary for improving the technical effect of the basic embodiment of the invention. A suitable additional measure is to provide the toilet bowl or the corresponding sewage providing unit with an airtight lid 17. Such a lid should be made relatively sound-proof. Opening of the sewer valve can, as known per se, easily be made dependent on the closing of the lid 17, so that the valve opens only when the lid is closed.

Using an airtight lid in a vacuum toilet may result in the amount of air present in the toilet bowl 1 being too small for efficient flushing. This can be cured by connecting an air tube 18 to the bowl 1. Air is led into the bowl through the tube 18 without any substantial noise. The air supply for the tube 18 can be taken from any place, for instance from outside the toilet compartment. Since the air inlet duct 4 is already present, the best solution is usually to supply air for the toilet bowl from this duct. In that case the tube 18 is connected to the air inlet duct 4 at a point upstream of the air inlet valve assembly 6.

FIG. 2 shows a valve closure member that is formed by an apertured rotatable disc 29. By rotating the disc 29 through 90 degrees counter-clockwise around its center 21, the aperture 28 of the disc is brought into line with a sewer duct **2*a* between the sewage providing unit and the vacuum sewer, whereby the sewer duct is fully opened. From this position, rotation of the disc 29 can be either continued in a counter-clockwise direction or reversed. When the disc 29 has been rotated in either direction 180 degrees from the open position of the sewer valve, the aperture 28 is in line with an air inlet valve 4*a***, which is then fully opened.

FIG. 3A shows the opening and closing of the sewer duct **2*a*** as a function of the turning angle a of the disc 29. and FIG. 3B correspondingly shows the opening and closing of the air inlet duct 4*a*. The opening percentage of the ducts 2*a* and 4*a* is shown on the vertical axis of both FIGS. 3A and 3B. If it is desired that the air inlet duct 4*a* should start to open before the sewer duct 2*a* is fully closed, the position of the duct 4*a* may be adjusted so that it is closer to the duct 2*a* at the right side of FIG. 2 along the moving path of the aperture 28. This, however, requires that the disc 29 be rotated only counter-clockwise.

In the embodiment according to FIG. 4, the disc 29 also has a smaller aperture 22. When the larger aperture 28 moves towards the sewer duct 2*a*, the smaller aperture 22 passes over the air inlet duct 4*a*, whereby this duct is partly opened as shown by the curve 25 in FIG. 5B. When the aperture 28 is in line with the sewer duct 2*a*, the smaller aperture 22 is at the position 22*a*, and therefore the duct 4*a* is closed. The disc 29 is then rotated in the opposite direction in order to close the sewer duct 2*a*. At the same time, the air inlet duct is again partly opened as shown by the curve 26 in FIG. 5B. By continuing rotation of the disc 29 in a clockwise direction beyond its initial position, the aperture 28 is brought into line with the air inlet duct 4*a*, which is then completely opened as shown by the left side half of the curve 27 in FIG. 5B. The aperture 22 is then at the position 22*b*. By rotating the disc 29 in a counter-clockwise direction back to its initial position the air inlet duct is closed as shown by the right side half of the curve 27 in FIG. 5B. In the embodiment according to FIG. 4 the air inlet duct opens partly in the initial phase of the opening of the sewer duct (curve 25) as well as in the end phase of its closing (curve 26). In this manner, the pressure difference across the sewer valve is reduced even before the air inlet valve is fully open, so as to reduce the rate at which air is inducted through the sewer valve during the opening phase of its operation. The mutual relative position of the curves of FIGS. 5A and 5B can be changed by changing the position of the ducts 2*a* and 4*a* and/or the position of the disc apertures 28 and 22. The opening percentages of the ducts 2*a* and 4*a* are shown in FIGS. 5A and 5B in the same manner as in FIGS. 3A and 3B.

A disadvantage of the vacuum sewer arrangement described with reference to FIG. 1 is that a vacuum accumulator is required in order to provide a sufficiently large volume under vacuum for proper functioning of the sewer valve and the air inlet valve. Also, since the air inlet valve opens after the sewer valve, and a single control device is used to control both the sewer valve and the air inlet valve, a throttle is required in order to delay operation of the air inlet valve relative to the sewer valve. Further, the proper location of the outlet 36 of the air inlet duct depends on several factors, and it is not possible to be certain that these factors will remain constant or will be the same from installation to installation.

Figure 6:
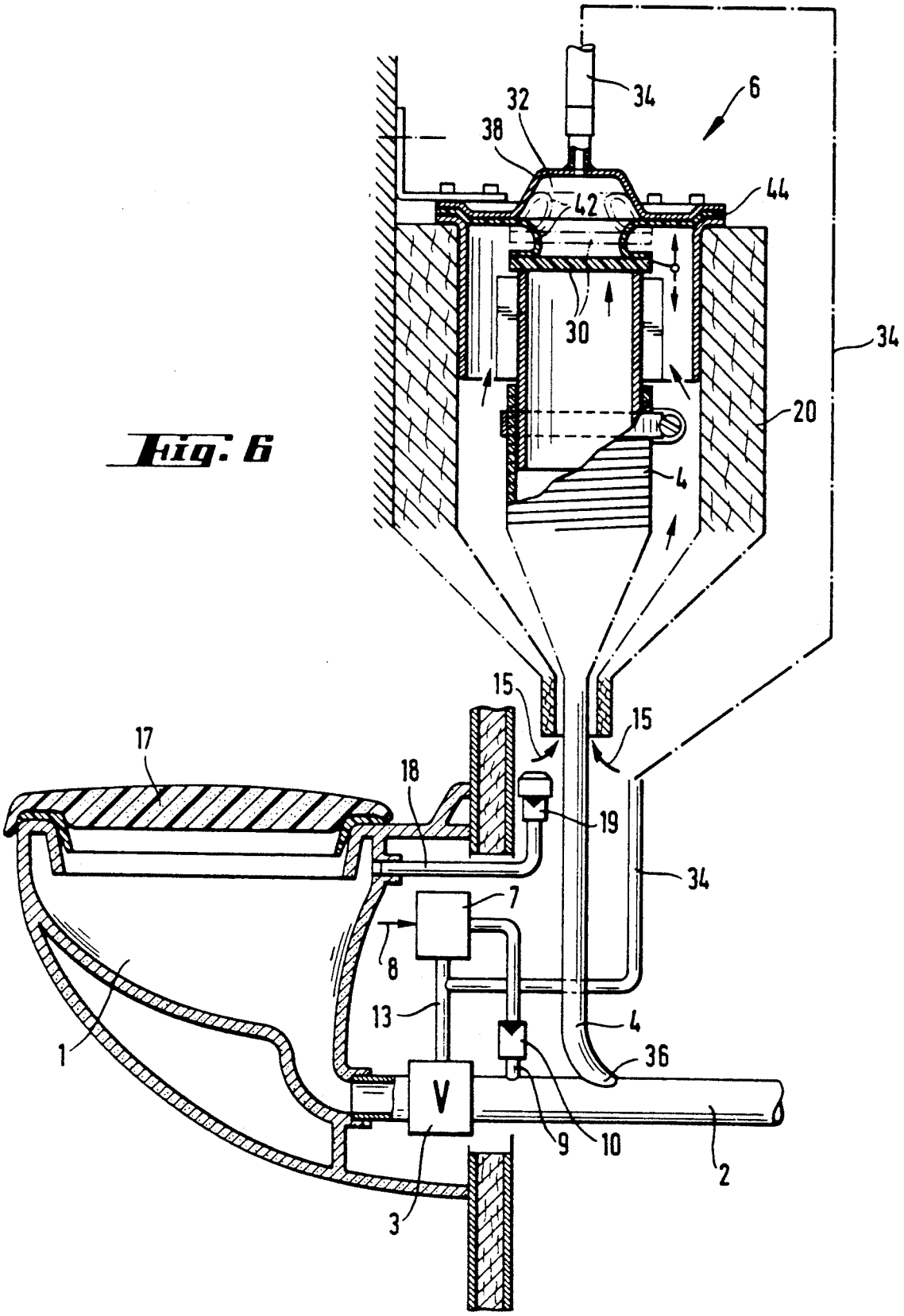
FIG. 6 shows schematically, and partly at an enlarged scale, a further embodiment of the invention with a vacuum operated sewer valve.

In the embodiment shown in FIG. 6, the air inlet valve 6 comprises a diaphragm 30 that is deflectable towards and away from the upper end of the duct 4, depending on the difference in pressure between the duct 4 and a diaphragm control chamber 32, which is connected by a narrow-bore tube 34 to the tube 13. The diaphragm control chamber is bounded partially by the diaphragm and partially by a rigid wall 38, to which the diaphragm is connected through a flexible rubber skirt 42 and a flange 44. The flexible rubber skirt 42 biases the diaphragm towards duct 4.

Normally, the pressure in tube 13 is atmospheric, while there is a lower pressure in the duct 4 because it is directly connected to the sewer 2, which is under vacuum. As a result, the diaphragm is held in firm sealing contact with the upper end of the duct 4. On receiving a function impulse 8, the control unit 7 communicates vacuum from the sewer 2 to the tube 13. This opens the sewer valve 3, and waste in the toilet bowl is drawn rapidly into the sewer 2.

The vacuum in tube 13 is communicated through the tube 34 to the diaphragm control chamber 32 and the pressures on the two sides of the diaphragm are then equal. However, owing to the bias provided by the resilient skirt 42, and the difference between the area of the diaphragm exposed to pressure in duct 4 and the area of the diaphragm and skirt effectively exposed to pressure in chamber 32, the diaphragm remains in contact with the duct 4 and therefore the air inlet valve remains closed. When the waste passes the outlet 36 of the duct 4, and is followed by air from the toilet bowl 1, the pressure in the duct 4 rises, but the check valve 10 prevents a corresponding rise in pressure in the tube 34. Consequently, the diaphragm 30 is unseated from the upper end of the duct 4, and air enters the sewer 2 through the duct 4. At about the same time as the air inlet valve opens, the control unit 7 communicates atmospheric pressure to the tube 13, causing the sewer valve 3 to close. Atmospheric pressure is also communicated to the control chamber 32, with a slight delay due to the length of the tube 34, and the air inlet valve closes.

The toilet lid 17 is in sealing relationship with the rim of the toilet bowl 1, and the function impulse can only be generated when the lid 17 is closed. When the sewer valve opens and waste is drawn into the sewer, air for transporting the waste is inducted into the toilet bowl through the tube 18 and the check valve 19 and the pressure in the sewer behind the waste remains close to atmospheric.

The outlet 36 of duct 4 is sufficiently close to the sewer valve that the operation of the sewer valve directly induces operation of the air inlet valve. Thus, when the sewer valve opens, it is the rise in pressure in the sewer when the waste from the toilet bowl passes outlet 36 that causes the air inlet valve to open, and when the sewer valve closes in response to control unit 7, the fall in pressure (increased vacuum) in the sewer causes the air inlet valve to close. Since the air inlet valve cannot open until the waste has passed outlet 36, there is no possibility of the air inlet valve opening too soon and interfering with reliable transportation of waste from the toilet bowl into the sewer.

Since the tube 34 is narrow, it has a small volume and therefore a sufficient degree of vacuum can be communicated from tube 13 to chamber 32 to ensure that the air inlet valve 6 opens when the pressure in duct 4 rises without need for a vacuum accumulator.

Figure 7:
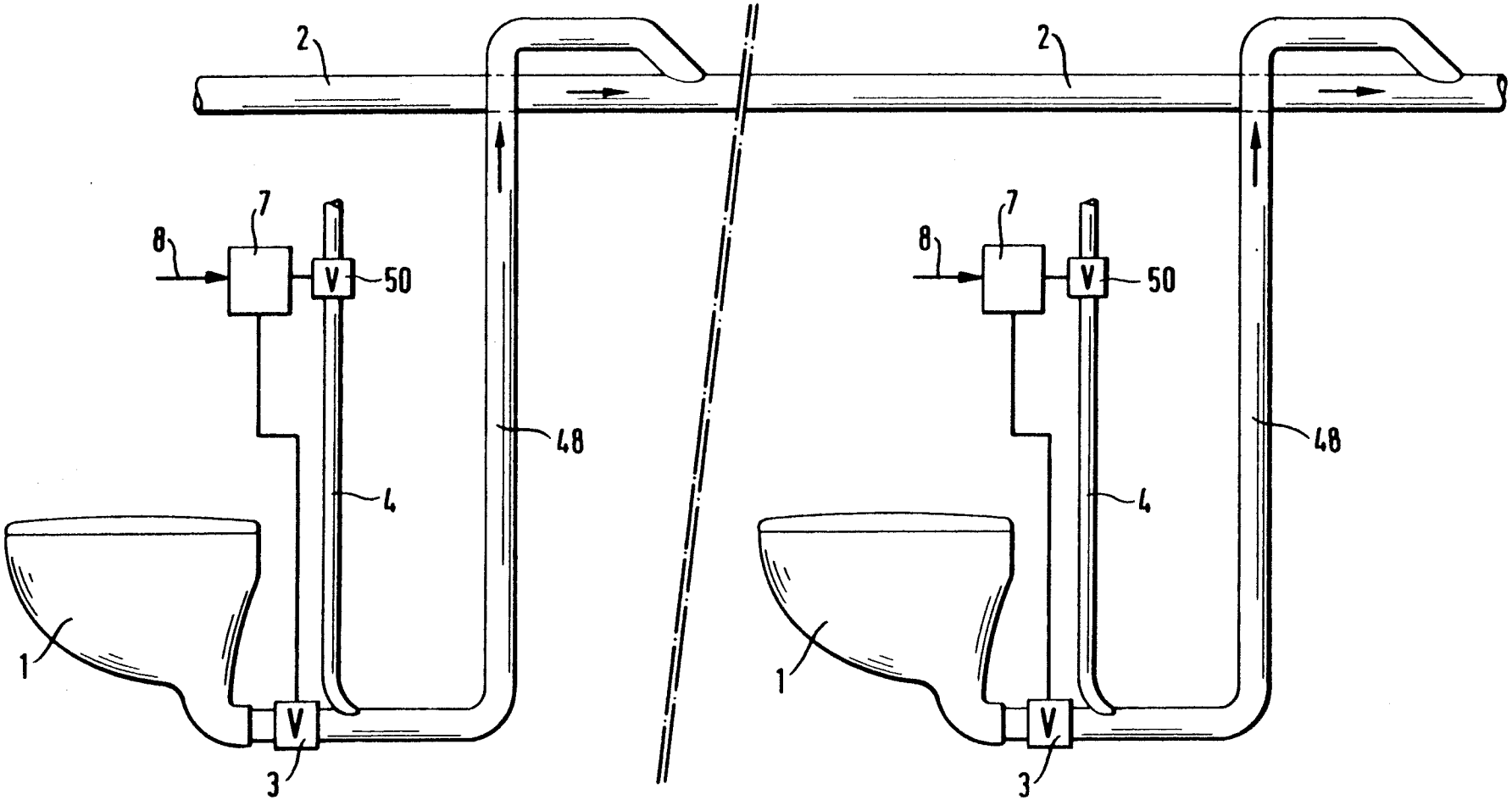
FIG. 7 shows schematically an arrangement having multiple toilet bowls.

FIG. 7 illustrates schematically an arrangement in which the sewer 2 has several branches 48 connected to respective toilet bowls 1 through respective sewer valves 3. An air inlet valve 50 and a control unit 7 are associated with each toilet bowl 1 and sewer valve 3. The arrangement of the toilet bowl, sewer valve, control unit and air inlet valve may be as shown in FIG. 1, 2, 4 or 6. The air inlet valves operate independently of one another, so that, for example, application of a function impulse to the control unit associated with one of the air inlet valves has no effect on the other air inlet valves.

It will be appreciated that the invention is not restricted to the particular embodiments that have been described, and that variations may be made therein without departing from the scope of the invention as defined in the appended claims and equivalents thereof.

We claim:

1. A vacuum sewer arrangement comprising:

a toilet bowl, a sewer defining an interior space, means for establishing, in the interior space of the sewer, a vacuum sufficient for obtaining efficient sewage transport, a positively operable, normally closed sewer valve having an inlet connected to the toilet bowl, an outlet connected to the sewer, and a control connection separate from the inlet and the outlet, the sewer valve having a closed condition in which sewage is retained in the toilet bowl when the sewer is under proper vacuum for sewage transport and an open condition in which sewage in the toilet bowl is forced into the sewer when the sewer is under proper vacuum for sewage transport, a sewer valve control device for controlling operation of the sewer valve in response to a flush command when the sewer is under proper vacuum for sewage transport, an air inlet duct for letting air into the sewer, separately from the toilet bowl, and a positively operable, normally closed air inlet valve for controlling flow of air through the air inlet duct into the sewer, the air inlet valve having a control connection that is connected to the sewer separately from the air inlet duct for operating the air inlet valve in response to pressure in the sewer at a point downstream of the sewer valve and opening the air inlet valve after opening of the sewer valve and closing the air inlet valve after closing of the sewer valve.

2. An arrangement according to claim 1, wherein the air inlet valve comprises an annular seat member defining an opening that is in open communication with the air inlet duct, a sealing member that is displaceable between a position in which it engages the seat member and a position in which it is spaced from the seat member, and means for controlling the position of the sealing member.

3. An arrangement according to claim 2, wherein the sealing member is a diaphragm, and the means for controlling the position of the sealing member comprise wall means defining a control chamber bounded by the sealing member, and means for controlling the pressure in the control chamber.

4. An arrangement according to claim 3, comprising a vacuum-actuated valve operating device connected to the sewer valve for opening the sewer valve, and wherein the control device comprises means for connecting the valve operating device selectively to either the sewer or ambient pressure.

5. An arrangement according to claim 4, wherein the control device comprises means for communicating vacuum to both the valve operating device and the control chamber.

6. An arrangement according to claim 2, wherein the annular seat member has an annular seat that surrounds said opening and the sealing member is displaceable between a position in which it engages the seat member around the entire periphery of the opening and a position in which it is spaced from the seat member around the entire periphery of the opening.

7. An arrangement according to claim 1, in which the toilet bowl has a lid that provides a substantially airtight closure.

8. An arrangement according to claim 7, in which the toilet bowl is provided with a tube for delivering air to the bowl when the lid of the bowl is closed.

9. An arrangement according to claim 8, in which the tube for delivering air to the toilet bowl is provided with a check valve.

10. An arrangement according to claim 1, further comprising a muffler through which ambient air passes in order to reach the air inlet valve.

11. A method of operating a vacuum sewer arrangement that comprises a toilet bowl, a sewer defining an interior space, a normally closed sewer valve connected between the toilet bowl and the sewer, and an air inlet duct for letting air into the sewer, separately from the toilet bowl, the air inlet duct being connected to the sewer at a point close to the sewer valve, said method comprising:

establishing, in the interior space of the sewer, a vacuum sufficient for obtaining effective sewage transport, opening the sewer valve, whereby sewage in the toilet bowl is inducted into the sewer and forms a movable plug therein, while the sewer valve is open, and after the sewage plug has passed the connection of the sewer and the air inlet duct, introducing air into the sewer by way of the air inlet duct, closing the sewer valve, continuing introduction of air into the sewer by way of the air inlet duct at least until the sewage plug has traveled the full length of the sewer or is at least 10 m from the sewer valve, and discontinuing introduction of air into the sewer.

12. A method according to claim 11, wherein the air inlet duct is connected to the sewer at a point that is spaced from the sewer valve by a distance such that when the sewer is under proper vacuum for sewage transport, sewage entering the sewer on opening of the sewer valve passes said point less than 0.5 seconds after the sewer valve reaches its fully open condition, and the method comprises commencing introduction of air into the sewer by way of the inlet duct between 1 and 2 seconds after opening the sewer valve and discontinuing introduction of air into the sewer within 5 seconds after commencing introduction of air.

13. An improved method of operating a vacuum sewer arrangement that comprises a toilet bowl, a sewer defining an interior space, and a normally closed sewer valve connected between the toilet bowl and the sewer, said method comprising:

establishing, in the interior space of the sewer, a vacuum sufficient for obtaining effective sewage transport, opening the sewer valve, whereby sewage in the toilet bowl is forced into the sewer, and closing the sewer valve, and wherein the improvement comprises:

letting air into the sewer separately from the toilet bowl at a predetermined point and during a predetermined interval, said predetermined point being spaced from the sewer valve by a distance such that when the sewer is under proper vacuum for sewage transport, sewage entering the sewer on opening of the sewer valve passes said point less than 0.5 seconds after the sewer valve reaches its fully open condition, and said predetermined interval beginning between 1 and 2 seconds after opening the sewer valve and ending within 5 seconds after its beginning, and said interval being selected relative to the opening and closing of the sewer valve such as not to interfere substantially with induction of sewage into the sewer while causing the level of noise due to flow of air into the toilet bowl to be substantially less than if no part of the air required for sewage transport were let into the sewer separately from the toilet bowl.

* * * * *